United States Patent [19]

Brooker

[11] 4,227,303

[45] Oct. 14, 1980

[54] FOLDING KNIFE

[75] Inventor: Dennis B. Brooker, Des Moines, Iowa

[73] Assignee: Brooker Folding Knives, Inc., Des Moines, Iowa

[21] Appl. No.: 14,605

[22] Filed: Feb. 23, 1979

[51] Int. Cl.[3] ..... B26B 1/04

[52] U.S. Cl. ..... 30/154

[58] Field of Search ..... 30/154, 155

[56] References Cited

U.S. PATENT DOCUMENTS

| | | | |
|---|---|---|---|
| 756,615 | 4/1904 | Fornander | 30/155 X |
| 2,276,026 | 3/1942 | Davidson | 30/154 X |

*Primary Examiner*—Jimmy C. Peters

*Attorney, Agent, or Firm*—Henderson & Sturm

[57] ABSTRACT

A folding knife having a handle with a slot formed therein has an arm member, one end of which is pivotally attached to the handle and pivotable between a first position disposed within the slot to a second position substantially outside of the slot. A knife blade has one end thereof pivotally attached to the other end of the arm member and is moveable when the arm member is in the second position thereof between a first position adjacent to the arm member and a second position wherein the knife blade extends away from the arm member for allowing the knife blade to be selectively folded into the handle for storage or out from the handle for use.

12 Claims, 8 Drawing Figures

FOLDING KNIFE

SUMMARY OF THE INVENTION

The present invention relates to a knife of a type having a handle with a slot formed therein. An arm member is pivotally attached to the handle and is moveable from a first position disposed in the slot to a second position substantially outside of the slot. A knife blade is pivotally attached to one end of the arm member and is pivotable when the arm member is in the second position thereof between a first position wherein the knife blade is adjacent to the arm member and a second position wherein the knife blade extends away from the arm member whereby the blade can selectively be folded into or out from the handle.

An object of the present invention is to provide an improved folding knife.

Another object of the invention is to provide a folding knife which eliminates the use of springs, a part which often fails.

A further object of the invention is to provide a folding knife which is easily disassembled for cleaning.

A still further object of the invention is to provide a folding knife which is economical and simple to manufacture and dependable to use.

Other objects, advantages, and novel features of the present invention will become apparent from the following detailed description of the invention when considered in conjunction with the accompanying drawings.

BACKGROUND OF THE INVENTION

The present invention relates generally to knives and more particularly to folding knifes.

Knives are, of course, one of the oldest and well known tools. Knives of the folding type typically include a blade pivoted directly to the handle. Springs, locks and mechanisms of all kinds have been attached to such basic structure. The problems, in general, with such mechanisms has been that such mechanisms tend to fail eventually, they are complicated to produce, the knives so produced are not easily disassembled for cleaning and they are expensive to manufacture.

Consequently there is a need for a folding knife which is economical to produce, dependable to use and easily disassembled for cleaning purposes.

DESCRIPTION OF THE PREFERRED EMBODIMENT

Figure 1:
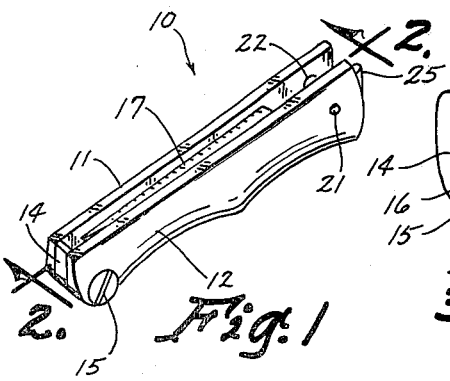
FIG. 1 is a perspective view of a knife constructed in accordance with the present invention.
Figure 3:
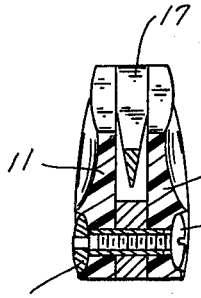
FIG. 3 is a cross sectional view taken along line 3—3 of FIG. 2.

Referring now to the drawings wherein like reference numerals designate identical or corresponding parts throughout the several views, FIG. 1 shows a knife 10 constructed in accordance with the present invention. The handle includes handle members 11 and 12 which are spaced apart to form a slot 13 therebetween. An arm member 14 is pivotally attached to the handle members 11 and 12 by means of a threaded fastener, including a threaded male portion 15 and a female thread portion 16 which are shown clearly in FIG. 3 to be threadably engaged with one another.

A knife blade 17 is pivotally attached to one end of the arm member 14 by a pin 18 which passes through an opening 19 in one end of the knife blade 17 and through an opening 20 in one end of the arm member 14. In the preferred embodiment of the invention, the pin can be rigidly affixed to one of the arm member 14 or the knife blade 17, but must be pivotally attached to the other. The pin 18, however, must be so affixed that it will not easily slide out of the openings 19 and 20. Alternatively, many other equivalent pivoting mechanisms can be used such as pivotally attaching the pin 18 to both 14 and 17. It is noted that the pivotal axis of the arm member 14 along the center line of the members 15 and 16 is generally perpendicularly disposed with respect to the axis of the pin 18.

Figure 4:
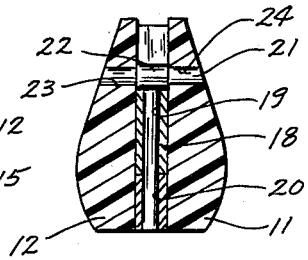
FIG. 4 is a cross sectional view taken along line 4—4 of FIG. 2.

A pin 21, as can best be seen in FIG. 4, has a spacer member 22 disposed therearound for presenting the handle members 11 and 12 from moving too close together. The spacer member 22 is of approximately the same dimension as the width of the arm member 14 and the widest part of the knife blade 17. The pin member 21 therefore holds the handle members 11 and 12 in the position shown in FIG. 4, primarily by means of being in a press fit relationship in the holes 23 and 24 of the handle members 11 and 12 respectively.

Figure 2:
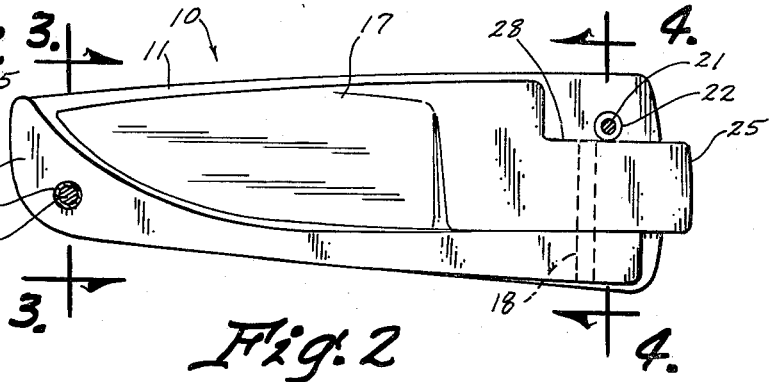
FIG. 2 is a cross sectional view taken along line 2—2 of FIG. 1.

The contour of the bottom edge of member 14 preferably substantially conforms to the shape of the bottom side of the handle members 11 and 12 as viewed in FIG. 2 to keep dirt or the like out of the knife and to have a smooth exterior on the bottom of the handle. The contour of the top edge of arm member 14, as viewed in FIG. 2, is approximately of the same shape as the lower sharpened portion of the blade 17 to allow the blade to be so aligned in the first position of the blade 17 with respect to the arm member 14 and to shield the blade from touching the interior of the knife, which thereby prevents the knife blade 17 from losing its sharp edge.

The knife 10 can be easily cleaned by removal of the treaded fastener members 15 and 16, thereby allowing the arm member 14 and knife blade 17 to be removed from the handle members 11 and 12.

Figure 5:
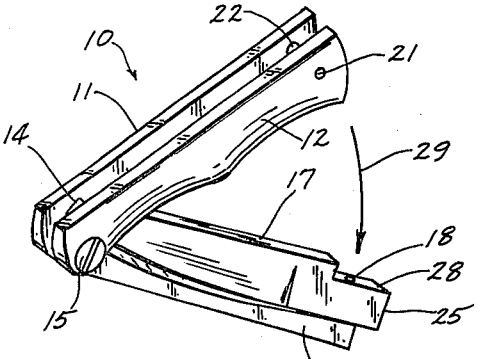
FIG. 5 is a perspective view similar to FIG. 1 but showing the knife in a preliminary stage of being unfolded.
Figure 7:
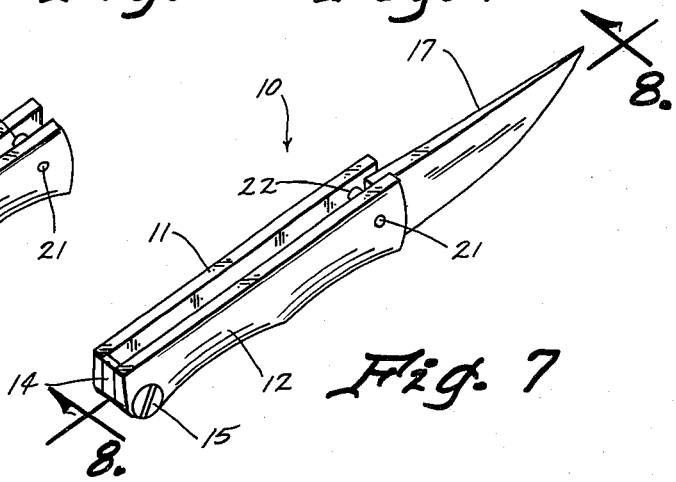
FIG. 7 is a perspective view like FIG. 1 but showing the knife being in a completely unfolded and ready for use position.
Figure 8:
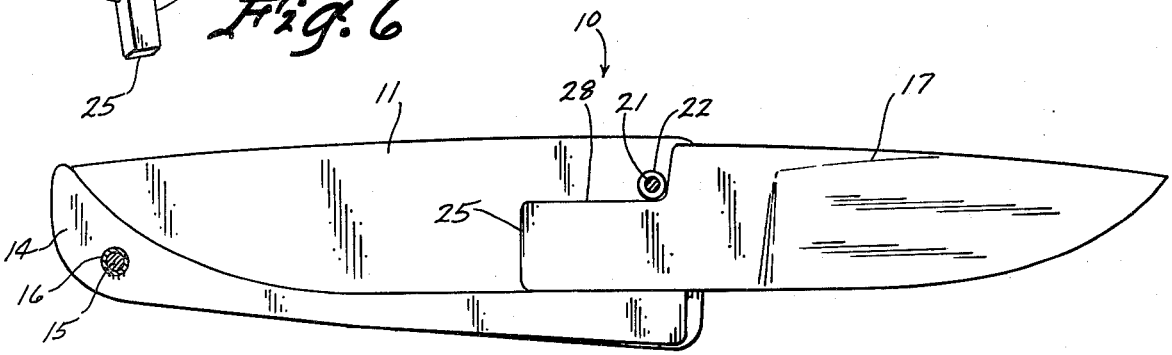
FIG. 8 is a cross sectional view taken along line 8—8 of FIG. 7.

In operation, the knife would normally be in the position shown in FIG. 1, such that it would be placed in a pocket without fear of exposing the sharp edge of the knife blade 17. It could, of course, also be placed in a case or the like. In order to unfold the knife of the present invention, one would grasp the handle members 11 and 12 with one hand and then pull the portion 25 of the knife blade 17 which sticks out of the end of the knife, as can be clearly seen in FIG. 1, downwardly as is shown in FIG. 5. Once the arm member 14 and knife blade 17 have been moved to the position approximately shown in FIG. 6 of the arm member 14, then the knife blade 17 can be pivoted along the axis of the pin 18 to the extended aligned second position thereof by pivoting the knife blade 17 in the direction shown by the arrow 26 or in the opposite pivotal direction. Once realignment of the knife blade 17 with the arm member 14 has occured, but with the knife blade 17 extending outwardly in the second position thereof, then the arm 14 and knife blade 17 are pivoted along the axis of the members 15 and 16 in the direction of the arrow 27 back to the position shown in FIGS. 7 and 8. It is noted that in the position shown in FIGS. 7 and 8, the surface 28 of the portion 25 of the knife blade 17 abuts the spacer sleeve stop member 22 such that it cannot pivot further upwardly. Since any cutting pressure occurs on the sharpened edge on the bottom portion of the knife blade 17 all such pressure is resisted by the pin 21 and sleeve 22.

Figure 6:
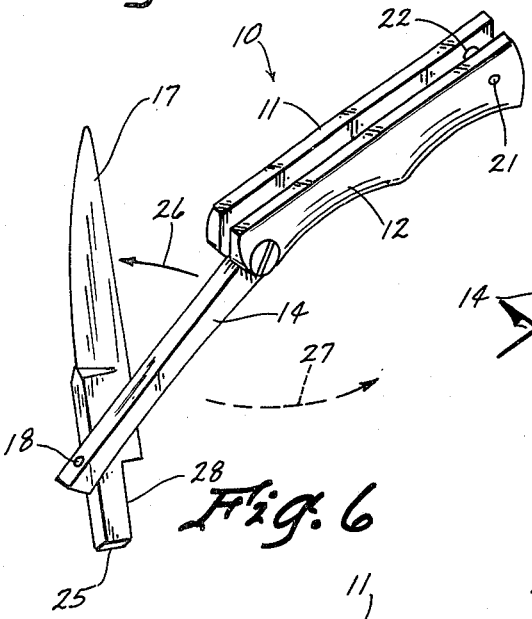
FIG. 6 is a perspective view like FIGS. 1 and 5 but showing the knife in a still further stage of being unfolded.

When it is desired to move the blade 17 back into the handle, a reverse procedure is used whereby the arm member 14 and blade 17 are pivoted back to the position that arm member 14 is shown in FIG. 6 (the second position thereof). The blade 17 is then pivoted back to the first position thereof with respect to the arm member 14 (for example as shown in FIGS. 2 and 5) and then the arm member 14 and 17, when so aligned, can be pivoted back upwardly into the slot 13 to the storage position shown in FIGS. 1 and 2.

Obviously many modifications and variations of the present invention are possible in light of the above teachings. It is therefore to be understood that, within the scope of the appended claims, the invention may be practiced otherwise then as specifically described.

I claim:

1. A knife comprising:

a handle having a slot formed therein;

an arm member;

means for pivotally attaching one end of the arm member to the handle along a first axis, said arm member being pivotable between a first position disposed in said slot and a second position substantially outside of said slot;

a knife blade;

means for pivotally attaching one end of the knife blade to the other end of said arm member along a second axis, the second axis being generally transversely disposed with respect to the first axis, said knife blade being pivotable when said first arm member is in the second position thereof between a first position wherein said knife blade is adjacent to said arm member and a second position wherein the knife blade extends away from the arm member.

2. The knife of claim 1 wherein said handle comprises:

a first handle member;

a second handle member;

means for attaching said first and second members together and forming said slot therebetween.

3. The knife of claim 2 wherein said attaching means includes a pin attached to said first and second members and a spacer means disposed around the pin and in the slot for preventing the first and second members from moving too close together.

4. The knife of claim 3 including stop means for preventing the arm means from pivoting beyond the first position from the second position thereof when said arm member is in the first position thereof.

5. The knife of claim 4 wherein said stop means comprises a surface on said one end of the knife blade for abutment with said spacer means.

6. The knife of claim 2 wherein said arm means is substantially the same thickness as said slot.

7. The knife of claim 6 wherein said knife blade is no thicker than said slot whereby it can be received within the slot beside the arm member in the first positions respectively of said knife blade and arm member.

8. The knife of claim 1 wherein said knife blade and arm member are disposed generally within the same plane in the first and second positions of said knife blade and in different planes when the knife blade is between said first and second positions thereof.

9. The knife of claim 1, wherein one edge of said arm member conforms to a portion of the outside contour of the handle in the first position thereof.

10. The knife of claim 9 wherein the other edge said arm member conforms generally to the adjacent portion of the knife blade when the knife blade is in the first position thereof.

11. The knife of claim 10 wherein the adjacent portion of the knife blade is a sharpened edge and the opposite edge of the knife blade is approximately the thickness of the slot for preventing dirt or the like from entering the slot in such position.

12. The knife of claim 1 wherein said means for pivotally attaching the arm member to the handle comprises a threaded fastener assembly extending through the handle and slot.

* * * * *